US005238272A

United States Patent [19]

Taylor

[11] Patent Number: 5,238,272

[45] Date of Patent: Aug. 24, 1993

[54] PROTECTED BAR CODE LABEL

[75] Inventor: J. E. Gordon Taylor, Centerville, Ohio

[73] Assignee: NCR Corporation, Dayton, Ohio

[21] Appl. No.: 845,972

[22] Filed: Mar. 4, 1992

[51] Int. Cl.[5] ..... B42D 15/00

[52] U.S. Cl. ..... 285/79; 285/81; 285/101

[58] Field of Search ..... 283/79, 80, 81, 101, 283/105; 428/40–43; 40/299

[56] References Cited

U.S. PATENT DOCUMENTS

| | | | |
|---|---|---|---|
| 4,110,502 | 8/1978 | Baer | 428/40 |
| 4,159,586 | 7/1979 | Blum | 40/2 R |
| 4,180,284 | 12/1979 | Ashley | 283/20 |
| 4,323,608 | 4/1982 | Denny et al. | 428/43 |
| 4,379,573 | 4/1983 | Lomeli et al. | 428/42 |
| 4,457,539 | 7/1984 | Hamisch, Jr. | 283/81 |
| 4,614,361 | 9/1986 | Foster | 282/8 R |
| 4,621,837 | 11/1986 | Mack | 283/105 |
| 4,821,439 | 4/1989 | Wilck | 40/638 |
| 4,910,058 | 3/1990 | Jameson | 428/42 |
| 4,927,179 | 5/1990 | Ehret et al. | 283/79 |
| 4,932,684 | 6/1990 | Vermeulen | 283/81 |
| 4,936,606 | 6/1990 | Moss | 283/70 |
| 5,071,167 | 12/1991 | O'Brien | 283/79 |

FOREIGN PATENT DOCUMENTS

| | | | |
|---|---|---|---|
| 1030178 | 4/1978 | Canada | 283/79 |

*Primary Examiner*—Mark Rosenbaum
*Assistant Examiner*—Willmon Fridie, Jr.
*Attorney, Agent, or Firm*—Craig E. Miller; George J. Muckenthaler

[57] ABSTRACT

A multiple ply label has an extension that includes a bar code symbol and the extension is folded under the label ply when the label is attached to an article for the purpose of protecting the bar code symbol. Another embodiment of the multiple ply label has a cutout portion that allows a bar code symbol to be positioned so as to be partially covered by an overlying ply when the label is attached to an article for the purpose of protecting one portion of the bar code symbol while exposing the other portion of the symbol. The overlying layers or plies of the multiple ply label can be removed at successive stations while protecting the bar code symbol.

18 Claims, 8 Drawing Sheets

10

PROTECTED BAR CODE LABEL

BACKGROUND OF THE INVENTION

In the field of labels or like media of the pressure-sensitive type, conventional manufacture of such labels involves the use of a pressure-sensitive material that is applied to a substrate or face stock, usually paper, in the form of a continuous web. The pressure-sensitive material on the substrate is then dried to form a bond of the material and the substrate. A release sheet or liner, also usually provided as a continuous web that is coated with a release agent, is applied to the exposed pressure-sensitive material, adhesive surface to form a substrate-pressure-sensitive, adhesive-release, sheet label stock.

It is known that pressure-sensitive labels or like media provide carrier means for bar code symbols that are used on numerous products for identification and pricing matters. The labels are applied to the article or product by the manufacturer and the bar codes are used by wholesalers and retailers in the course of business in dealing with the customer or end user.

It is also known that labels bearing such bar code symbols are provided with a coating or protective agent so that the bar code survives tests of time and environment. In this regard, it is extremely important that the bar code be readily acceptable and in good condition for reading or scanning by a bar code reader.

Representative documentation in the field of pressure-sensitive labels or the like includes U.S. Pat. No. 4,159,586, issued to J. J. Blum on Jul. 3, 1979, which discloses a labeling system having a transport cover sheet, a removable separator sheet, a label and a removable backing sheet. The cover sheet and the separator sheet may be folded back to expose the label.

U.S. Pat. No. 4,180,284, issued to J. E. Ashley on Dec. 25, 1979, discloses an identifying tag having a label with one of a plurality of geometrical shapes, one of a plurality of colors, and one of a plurality of alphanumeric characters.

U.S. Pat. No. 4,323,608, issued to R. W. Denny et al. on Apr. 6, 1982, discloses a label having a first sheet portion with a protective liner, and a second strip portion. The second strip portion is folded under the first sheet portion and has tear lines to enable removal of a front part to expose printed matter.

U.S. Pat. No. 4,379,573, issued to R. C. Lomeli et al. on Apr. 12, 1983, discloses a business form with a removable label that includes a layer adhesively secured to a substrate which is die cut and peelable from the layer.

U.S. Pat. No. 4,457,539, issued to P. H. Hamisch on Jul. 3, 1984, discloses a composite label web that includes a carrier web and a label web. The label web is divided into a series of labels having three parts and two of the parts provide a projecting portion that is folded under one part.

U.S. Pat. No. 4,614,361, issued to R. S. Foster on Sep. 30, 1986, discloses a shipping label having an upper layer, an intermediate layer, and a lower layer with spaces for data or address, and the lower layer is die cut to allow removal thereof for attaching to a document.

U.S. Pat. No. 4,621,837, issued to J. B. Mack on Nov. 11, 1986, discloses a multi-layered label with a first cover sheet and a second cover sheet and a folded leaflet member which is swung open along a hinge line.

U.S. Pat. No. 4,821,439, issued to K. H. Wilck on Apr. 18, 1989, discloses a composite label with a base sheet removably adhered to a stock carrier and having a cover sheet removably connected to the base sheet. The base sheet includes an upper sheet with cutout portions and a lower sheet with a smooth surface for easy separation of labels in the cutout portions.

U.S. Pat. No. 4,910,058, issued to J. R. Jameson on Mar. 20, 1990, discloses a multi-ply form with a first web and a second web, the first web having a die-cut portion with an additional die-cut segment within the die-cut portion, and the second web having a die-cut portion in registry with the first die-cut portion and with a label.

U.S. Pat. No. 4,927,179, issued to B. A. Ehret et al. on May 22, 1990, discloses a shipping label with a price tag portion folded thereunder, and a release liner releasably adhered to the label. The price tag portion is smaller than the label and the label has a perf line for removal of a portion of the label.

U.S. Pat. No. 4,932,684, issued to F. C. Vermeulen on Jun. 12, 1990, discloses a multi-ply substrate and a label thereon. The substrate is releasably secured to a temporary carrier, and the parts have adhesive surfaces enabling removal of separate portions.

And, U.S. Pat. No. 4,936,606, issued to J. W. Moss on Jun. 26, 1990, discloses a label with closed peripheral portions removable to define indicia and a cover over the portions and extending beyond the margins of the label.

SUMMARY OF THE INVENTION

The present invention relates to pressure-sensitive labels that can be imprinted with variable information and then applied to a surface. The variable information is that information which is printed on a labeled surface and on a portion or portions separable therefrom. In addition to the variable information, a preprinted image can be applied to the surface. A portion or portions of a label assembly can be removed from other portions for use as an instruction, as an invoice, or as means to transfer the variable information to another location. The label assembly includes one or more plies which are removed in the process of transporting an article or product from manufacturer to end user.

The pressure-sensitive label of the present invention includes a portion of the label on which is printed a bar code symbol. The bar code symbol portion, in one embodiment, extends from one edge or side of the label and is folded under the label for the purpose of protecting the bar code symbol during use of the label in a process operation. The bar code symbol portion, in another embodiment, is provided as an extension of the label and the bar code symbol occupies a part of the bar code portion which is under the label. In the first embodiment, the entire bar code is protected by the overlying label. In the second embodiment, a portion of the bar code is exposed for view and use by the user of the label and a portion of the bar code is under the label for protection of such portion of the bar code.

The label includes a top ply that is secured to the face of an intermediate ply by means of lines of adhesive and the intermediate ply is secured to the face of the label. The label includes an adhesive coating on the back side thereof and a liner ply is provided to cover the adhesive coating. The top ply and the intermediate ply have lines of perforations adjacent the lines of adhesive so as to enable removal of portions of such plies by the users of the label.

The present invention provides a multiple ply label having an extension that includes a bar code symbol and the extension is folded under the label ply when the label is secured to an article for the purpose of protecting the bar code symbol during time of transit along a process line. Another arrangement of the multiple ply label has a cutout portion that includes a bar code positioned so as to be partially covered by an overlying ply when the label is secured to an article for the purpose of protecting one portion of the bar code symbol while exposing another portion of the symbol. The overlying layers or plies can be removed by means of the lines of perforations as the article moves past successive stations along a process line and while protecting the bar code symbol from environmental matter.

In accordance with the above discussion, a principal object of the present invention is to provide a pressure-sensitive label having a protected bar code symbol thereon.

Another object of the present invention is to provide a multiple ply label having an extended portion with a bar code symbol thereon and the extended portion is folded under the label to protect the bar code symbol.

An additional object of the present invention is to provide a multiple ply label having a cutout portion that includes a bar code symbol positioned so as to be partially covered by the label for protecting a portion of the bar code symbol.

A further object of the present invention is to provide a multiple ply label that includes a portion having a bar code symbol positioned thereon and protected when the label is affixed to an article and one or more plies are removable from the label at successive stations with the bar code symbol staying intact with the label.

Additional advantages and features of the present invention will become apparent and fully understood from a reading of the following description taken together with the annexed drawing.

DESCRIPTION OF THE PREFERRED EMBODIMENT

Figure 1:
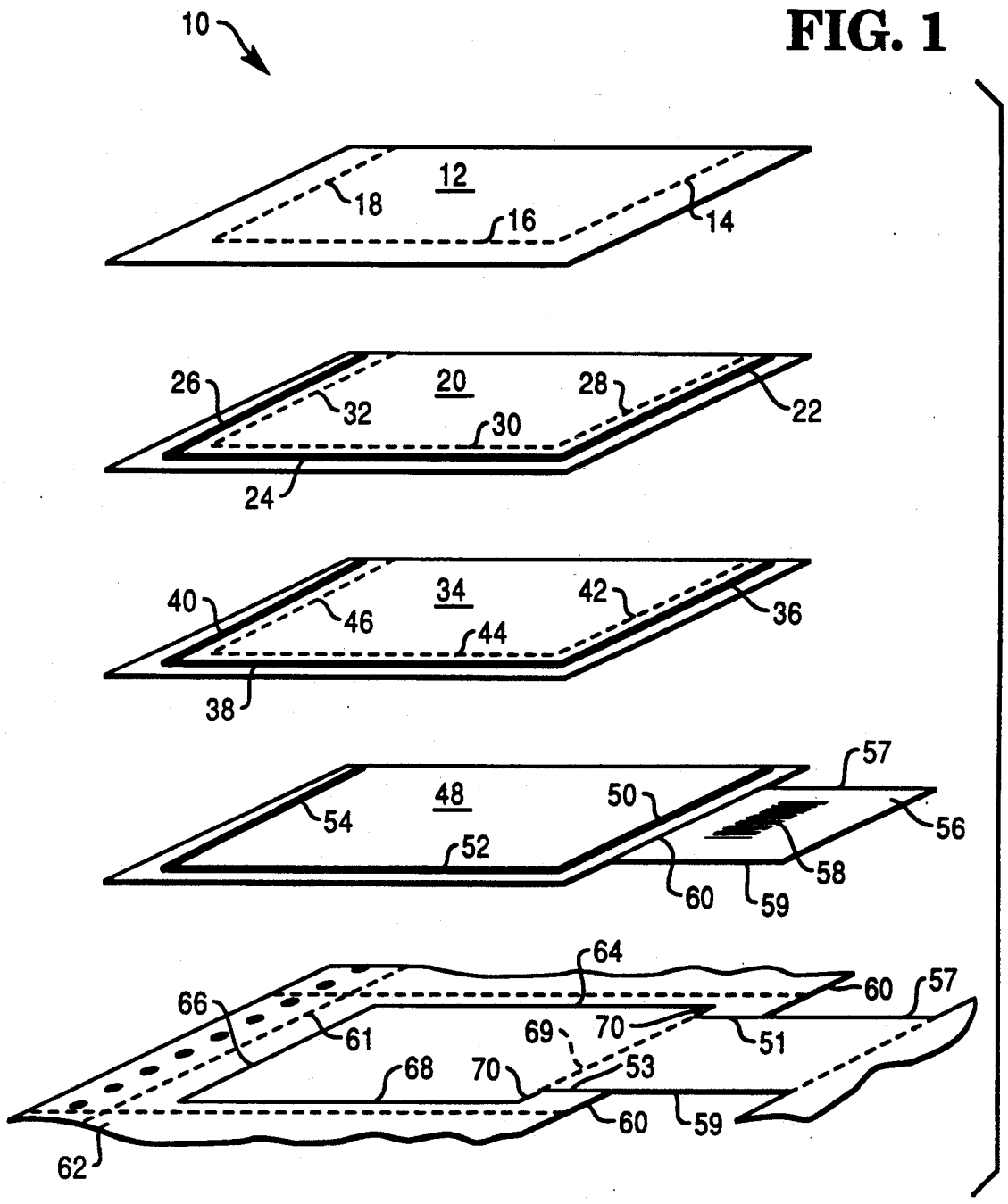
FIG. 1 is an exploded view of the several layers or plies of one embodiment of a multiple ply label in accordance with the present invention.
Figure 2:
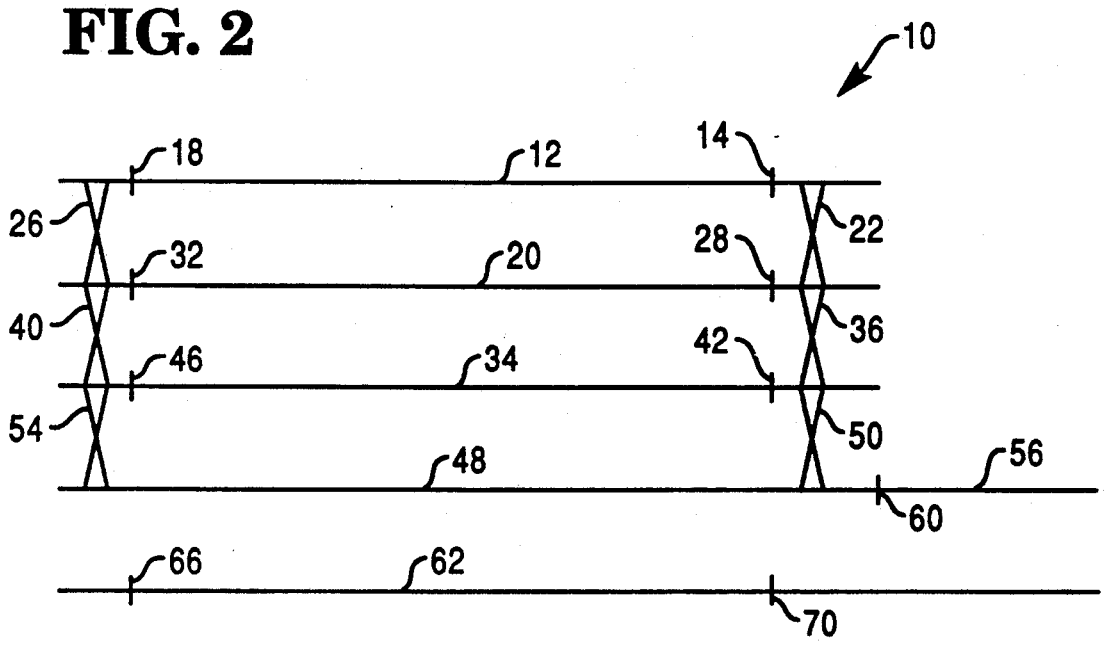
FIG. 2 is an enlarged end view of the label of FIG. 1.
Figure 3:
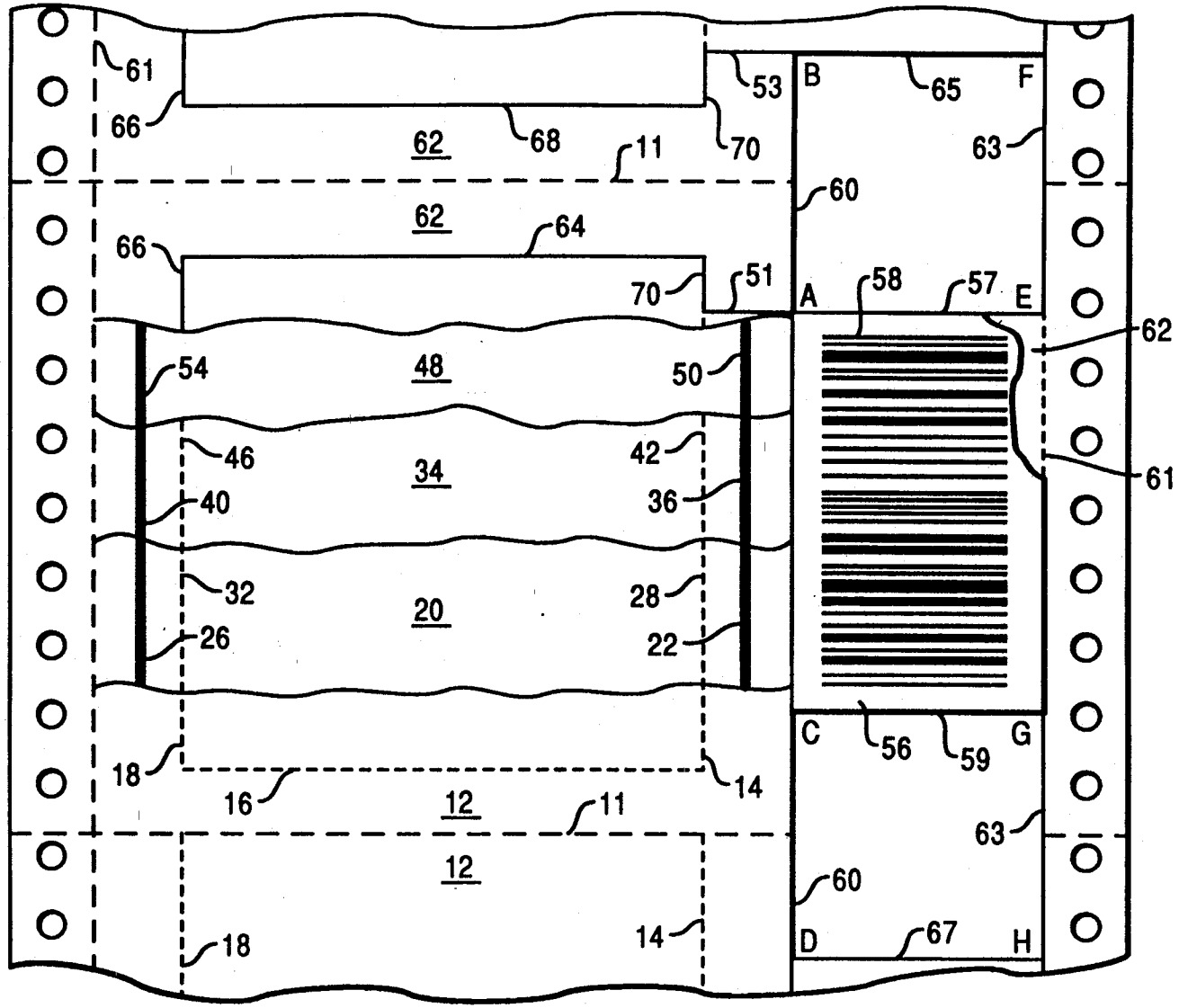
FIG. 3 is a plan view of the label showing cutaway portions of the several layers and illustrating the label as one of a continuous web of labels.

Referring now to the drawing, FIGS. 1, 2 and 3 show a multiple ply label, generally designated as 10, and including a first or top ply 12 which is about four inches square. Of course, the label may be of any size or shape and may have two or more plies to fit the application for which the label is intended. The top ply 12 has a line of perforations 14 adjacent and spaced from the right hand edge of the ply, a line of perforations 16 adjacent and spaced from the lower edge of the ply (FIG. 1), and a line of perforations 18 adjacent and spaced from the left hand edge of the ply 12. An adjacent multiple ply label 10 of a continuous web of labels (FIG. 3) includes a line of perforations 11 extending across and separating the labels and connecting with perforation lines 14 and 18.

A second ply 20 of the same size and shape as the first ply 12 has a line of adhesive 22 adjacent and spaced from the right hand edge of the ply, a line of adhesive 24 adjacent and spaced from the lower edge of the ply (FIG. 1), and a line of adhesive 26 adjacent and spaced from the left hand edge of the ply 20. A line of perforations 28 is adjacent and inward of the line of adhesive 22, a line of perforations 30 is adjacent and inward of the line of adhesive 24 (FIG. 1), and a line of perforations 32 is adjacent and inward of the line of adhesive 26 of the ply 20. In other words and as seen in FIG. 1, the lines of perforations 28, 30 and 32 are located inside or toward the center of the ply 20 from the glue lines 22, 24 and 26.

The label 10 has a third ply 34 of the same size and shape as plies 12 and 20 and has a line of adhesive 36 adjacent and spaced from the right hand edge of the ply, a line of adhesive 38 adjacent and spaced from the lower edge of the ply (FIG. 1), and a line of adhesive 40 adjacent and spaced from the left hand edge of the ply 34. A line of perforations 42 is adjacent and inward of the line of adhesive 36, a line of perforations 44 is adjacent and inward of the line of adhesive 38, and a line of perforations 46 is adjacent and inward of the line of adhesive 40 of the ply 34. The lines of perforations 42, 44 and 46 are located inside or toward the center of the ply 34 from the glue lines 36, 38 and 40.

A fourth ply 48 is the label ply of the label assembly and includes a line of adhesive 50 adjacent and spaced from the right hand edge of the ply, a line of adhesive 52 adjacent and spaced from the lower edge of the ply, and a line of adhesive 54 adjacent and spaced from the left hand edge of the ply 48. The fourth ply or label ply 48 has an extended portion 56 of about one and one-half inches by about two and one-half inches at the right hand side of the ply 48. The extended portion 56 has a bar code symbol 58 (FIG. 3) imprinted thereon and a cut or slit 60 is positioned along the right hand edge of the ply 48 and serves to sever the extended portion 56 from the main portion of the fourth ply 48.

A liner 62 is provided on the back side of the label ply 48 and extends beyond the edges of the label ply 48 in a continuous web arrangement, as best shown in FIG. 3, and is positioned in a manner to protect the back side of the ply 48. The back side of the label ply 48 is coated with releasable adhesive wherein, upon removal of the liner 62, the label ply 48 can be secured to an article or other product. The liner 62 has a slit 64 adjacent and spaced inward from the upper edge of the liner, a slit 66 adjacent and spaced inward from the left hand edge of the liner, and a slit 68 adjacent and spaced inward from the lower edge of the liner. A slit 70 (FIGS. 1 and 3) extends from the right hand end of line 64 to the left hand end of a line 51 and a like slit 70 extends from the right hand end of line 68 to the left hand end of a line 53. The slit 70 is positioned inward of the right hand edges of the first, second and third plies 12, 20 and 34 (FIG. 2). The liner 62 has the slit line 51 extending from the slit 70 to a line 57 adjacent one end of the bar code symbol 58 (FIG. 3) and has the slit line 53 extending from the slit 70 to a line 59 adjacent the other end of the bar code symbol. A perforated portion 69 (FIG. 1) joins the two slits 70 and provides for ease of removal of a portion of the liner 62. The lines 57 and 59 represent slits in the liner 62 and in the label ply 48. The slits 57 and 59 are positioned in the label ply 48 and in the liner 62 and extend therein toward the right from the right hand edge of plies 12, 20 and 34.

The top ply 12 has a carbonless coating on the back side (coated back or CB), the second ply 20 has a carbonless coating on the front side and on the back side (coated front and back or CFB), the third ply 34 has a carbonless coating on the front side and on the back side (coated front and back or CFB), and the fourth or label ply 48 has a carbonless coating on the front side (coated front or CF) for the purpose of transferring printing or like marking from the top ply 12 to the respective plies 20, 34 and 48.

Figure 4A:
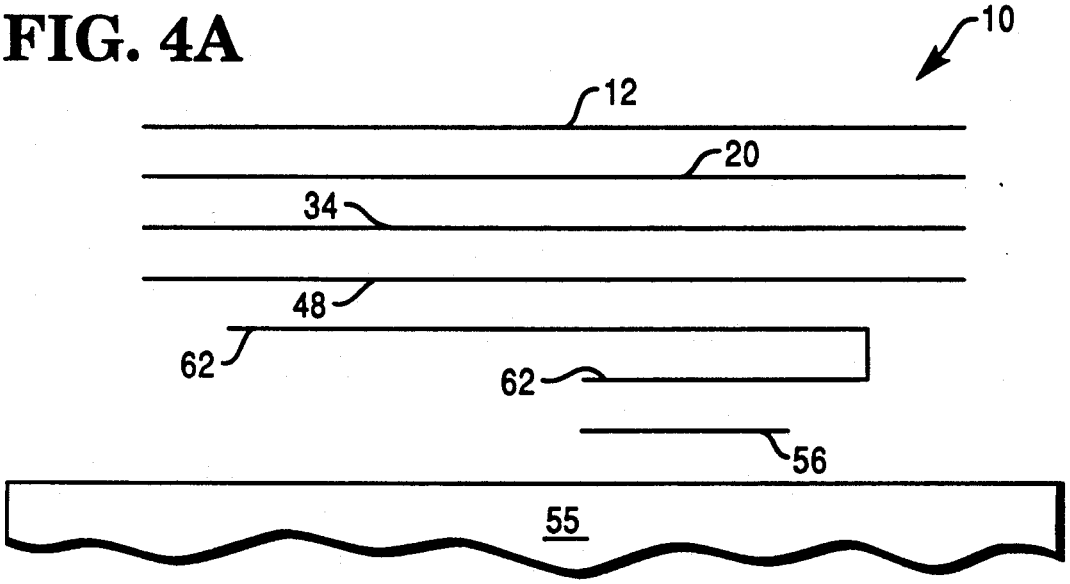
FIG. 4A, on the sheet with FIG. 2, is an end view showing one arrangement of the layers of the label when attached to an item or article.

It is seen that the first embodiment, as illustrated in FIGS. 1, 2 and 3 and described above, discloses a label 10 that provides for protecting the original image of the bar code symbol 58 and copies of associated human-readable information on the lower plies of the label. The label 10 is attached to items or products, as 55 in FIG. 4A, that are progressing through a series of manufacturing steps along a process or assembly line. One of the manufacturing steps may include spray painting of at least a part of the item or product 55 as it travels from station to station along the process line. Since only the original image of a bar code or similar machine-readable code can be used in the reading or scanning of the bar code, separate mechanisms may be required to protect machine-readable data and human-readable data that are imprinted on the same label.

The label 10 may include as many as four plies which are considered the maximum number for obtaining readable copies of an imprinted image. In this regard, it is necessary to have a readable imprint on the label ply 48.

While the label 10 is described above as having lines of adhesive along the right hand edge, the lower edge, and the left hand edge of the several plies, it may be desirable to also have an adhesive line along the upper edge of the plies that are secured to adjacent plies. An additional line of perforations may be included inside the adhesive line along the upper edges of the respective plies. In the case where all four edges or sides of the respective plies of the label are glued, one corner of each of the respective plies may be die cut to enable removal of the respective ply.

As noted above, the label ply 48 includes a portion 56 that extends beyond the right hand edge of the overlying plies and provides space for printing the bar code 58 or other like machine-readable image directly on the label portion 56 and which image must be an original image in order to be machine readable.

The liner ply 62 is cut or slit along the slit lines 64, 66, 68, 70, 51 and 53 (FIG. 1) in a manner to permit removal of a part of the perimeter portion of the liner ply 62 from the face stock or label ply 48. The slit lines are located approximately one-half inch inward from each edge of the label ply 48 to permit removal of the perimeter portion of the liner ply except for the right hand side adjacent the extended portion 56 of the label ply 48 and of the center portion of liner ply 62. The perforated portion 69 of line 70 is located approximately one-half inch from the right hand edge of the label ply 48. In this manner, the liner portion underlying the extended portion 56 of the label ply 48 can be removed from the back side of such extended portion when display and use of such portion are required.

The extended portion 56, as noted from the above mentioned size thereof, is shorter in the y-direction than the side of the label ply 48 from which such portion extends and such extended portion is centered on the side of the ply 48 (FIG. 1). The length of such portion 56 in the y-direction is made so as to fit within the limits of the retained portion of the liner 62 and which retained portion is enabled by means of the slit lines 64, 66, 68, the slit portions of line 70 and the slits 51 and 53 of lines 57 and 59, respectively. The length of the extended portion 56 in the x-direction is made so as not to exceed a length which can be conveniently folded under the main portion of the label ply 48 when the label is attached to an item or product 55 to be processed. The slit line 60 (FIGS. 1 and 3) may be provided in the label ply 48 only at the right hand edge thereof to enable folding of the extended portion 56 under the label ply 48 of the label to protect the bar code symbol 58. The slit line 60 also enables easy removal and repositioning of the bar code 58 for reading thereof, if desired.

Line 60 from A to B (FIG. 3) and line 60 from C to D are slits cut through the plies 48 and 62, and line 63 from E to F and line 63 from G to H are slits also cut through plies 48 and 62. Line 63 from E to G is perforated by line 61 through plies 56 (or 48) and 62. Lines 65, 67, 57 and 59 are slits cut through plies 56 (or 48) and 62. It is seen that open spaces of adjoining labels 10 are provided by slit lines 60, 65, 63 and 57 and by slit lines 60, 59, 63 and 67 at the right side of the labels. One square open space is outlined by A, B, F, E, A and another square open space is outlined by D, C, G, H, D. Line 51 from line 70 to the intersection with the left hand end of line 57 is cut through ply 62 and line 53 from line 70 to the intersection with the left hand end of line 59 is cut through the liner ply 62.

In the use of the label 10, imprinting such as work order instructions are imaged on the several plies of the label by means of a printer or like device (not shown) and by the carbonless coating on the respective plies. An original image of the bar code 58 or other machine-readable symbol is made on the extended portion 56 of the face stock of the label ply 48.

When the label ply 48 is attached to an item 55 to be processed (FIG. 4A), the extended portion 56 of ply 48 and its adhering liner portion of ply 62 are folded back under the main body of the label along perf line 69 to protect the bar code symbol 58 from spray paint or other image-obscuring materials. At the stage of the process when the bar code 58 is to be read, the appropriate (right hand) edge of the label 10 is lifted and the bar code portion 56 is withdrawn or unfolded from under the label. If permanent or semi-permanent attachment of the bar code portion 56 to an item or product 55 is desired, the liner 62 can be removed from under the extended portion 56 of the label ply 48 and such extended portion can be affixed directly to the item to be processed. The protected bar code can be easily and conveniently read in a manner free from interference of spray paint or any other foreign material.

Figure 4B:
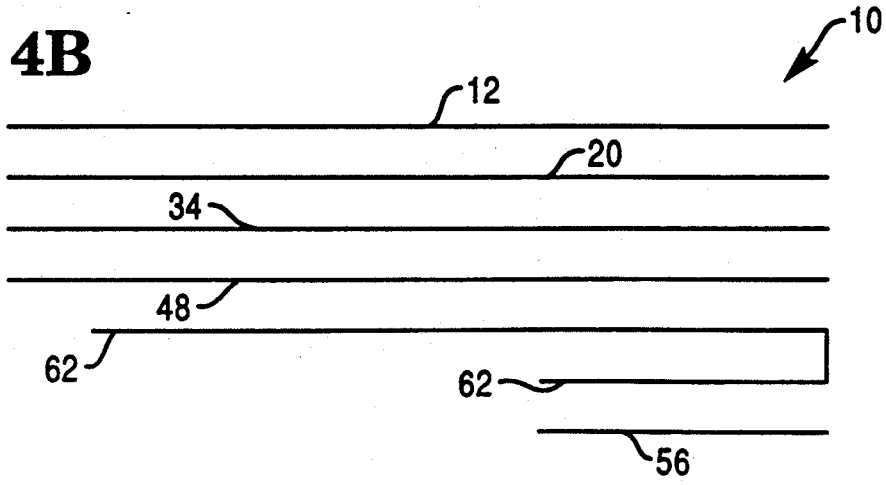
FIG. 4B, also on the sheet with FIG. 2, is an end view showing another arrangement of the layers of the label.

It is recognized that when folding the bar code portion 56 under the main body of the label ply 48 for protection of the bar code 58, the fold may be made along line 60. In this arrangement, an edgewise view of the label 10 attached to an item 55 is illustrated in FIG. 4B. Such an arrangement allows easier lifting of the edge of the label ply 48 and exposing the bar code portion 56, since the adhesive strip on ply 48 adjacent the bar code portion 56 is not adhered to the item 55.

Of course, it is recognized that the label ply 48 can be oriented in any direction so that the work order portion and the bar code portion of the label can be placed side-by-side relative to the web direction of the form or placed sequentially in the web direction. In the case of the label 48 which has an open, unglued edge of the overlying plies, as illustrated in FIG. 1, such open edge can be oriented along whichever side is most favored for ease of manufacture and use. Another variation in the assembly of the several plies of the label 48 is that of placing the glue lines and the perforated lines along only two opposite edges of the plies. As a convenience for grasping the overlying plies in the ply removal process, each ply may be made slightly longer along one unglued and unperforated edge than an underlying removable ply.

It is seen that the label form 10 of two or more plies, containing a work order and a bar code for an item or product that is being worked during a manufacturing process, is designed to produce multiple copies of the work order on one or more removable plies on the message or main body portion of the form, and an original machine-readable image 58 on an extended portion 56 of the label ply 48. In the use of the label form, the machine-readable image portion 56 of the label ply 48 is folded under the message portion of the label to protect such image from obliteration or defacing to an unreadable condition as by use of spray paint or like foreign material. The sequential removal, after spray painting, of the overlying plies of the message portion of the label permits display of the work order for subsequent processing. When processing of the item 55 is completed and the bar code 58 must be read, the bar code portion 56 is removed from under the body portion of the label 10.

A second embodiment of the present invention is shown in FIGS. 5–9 and comprises a label 71 wherein a top or first ply 72 of generally rectangular shape has a line of perforations 74 adjacent and spaced from the upper edge of the ply, a line of perforations 76 adjacent and spaced from the left hand edge of the ply, and a line of perforations 78 adjacent and spaced from the lower edge of the ply 72.

Figure 8:
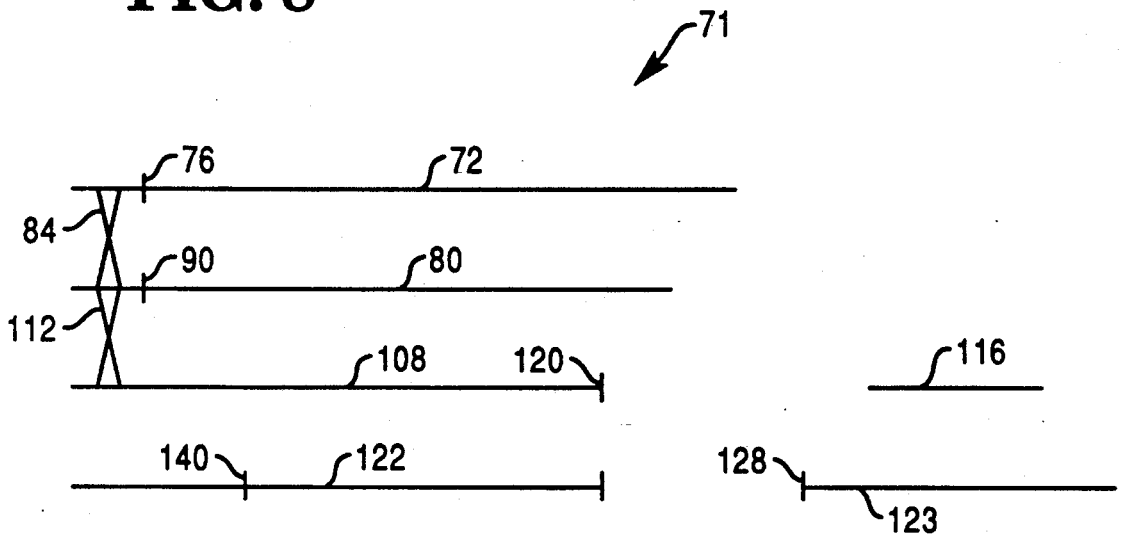
FIG. 8 is an enlarged end view of the label of FIG. 5.

A second ply 80 has a line of adhesive 82 (FIG. 5) adjacent and spaced from the upper edge of the ply, a line of adhesive 84 adjacent and spaced from the left hand edge of the ply, and a line of adhesive 86 adjacent and spaced from the lower edge of the ply 80. A line of perforations 88 is adjacent and inward of the adhesive line 82 (FIG. 5), a line of perforations 90 is adjacent and inward of the adhesive line 84, and a line of perforations 92 is adjacent and inward of the adhesive line 86 in the ply 80. The right hand edge of ply 80 is positioned to the left of the right hand edge of ply 72 (FIG. 8).

Figure 5:
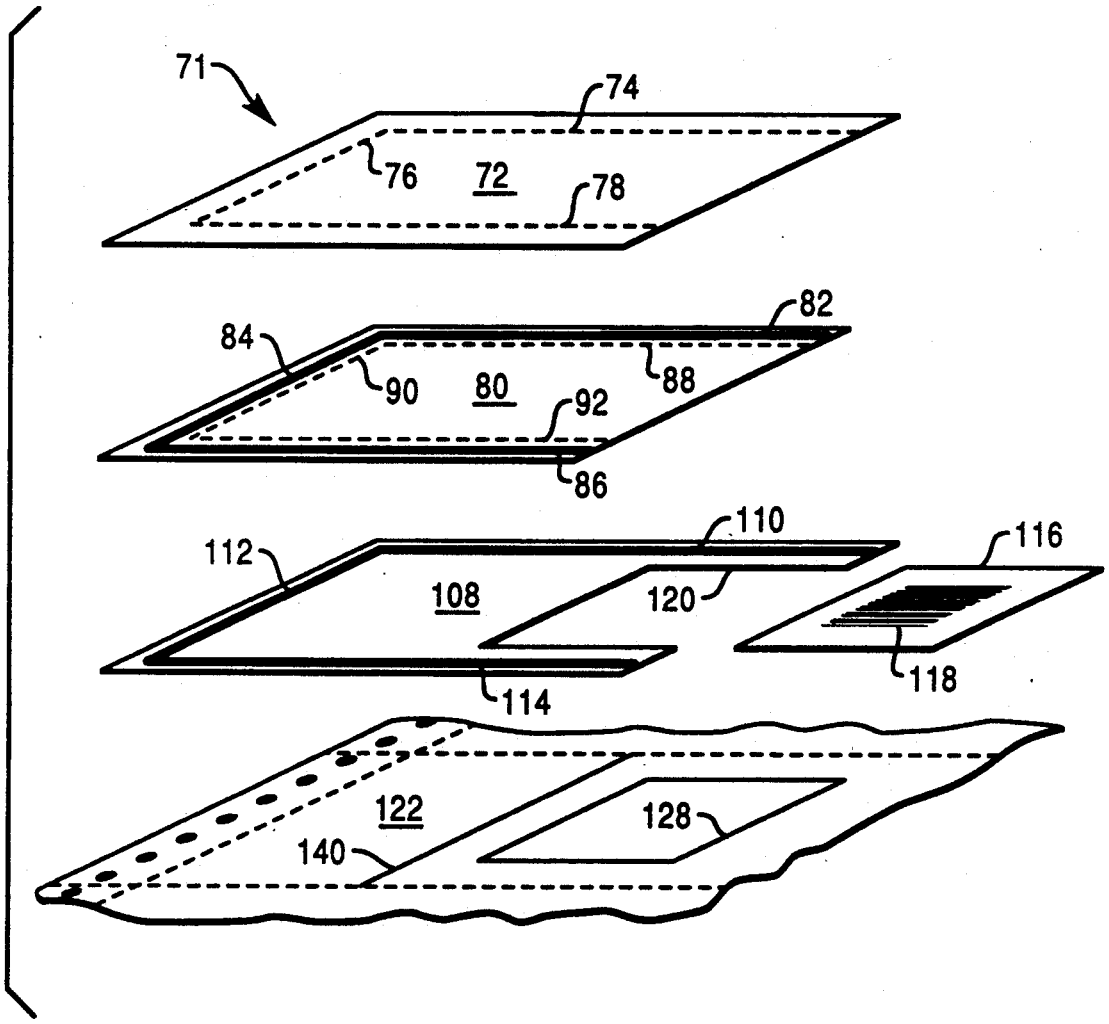
FIG. 5 is an exploded view of the several layers or plies of another embodiment of the multiple ply label.
Figure 6:
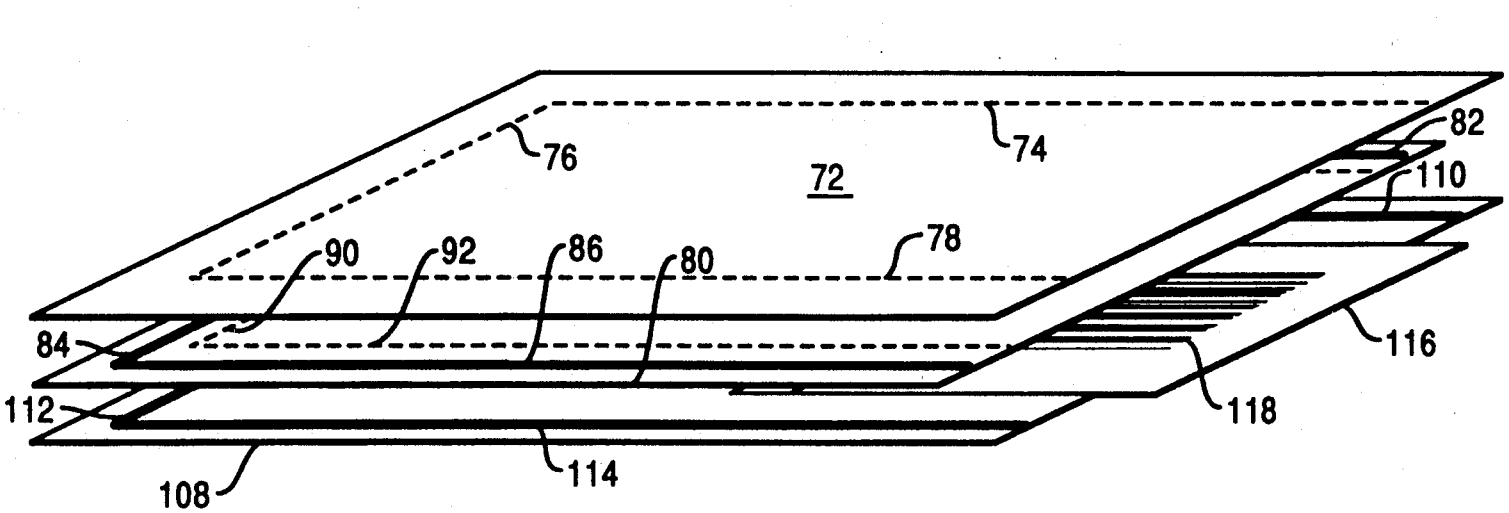
FIG. 6 is a view of the multiple ply label of FIG. 5 and showing a bar code symbol portion in position for placing on an item or article.
Figure 9:
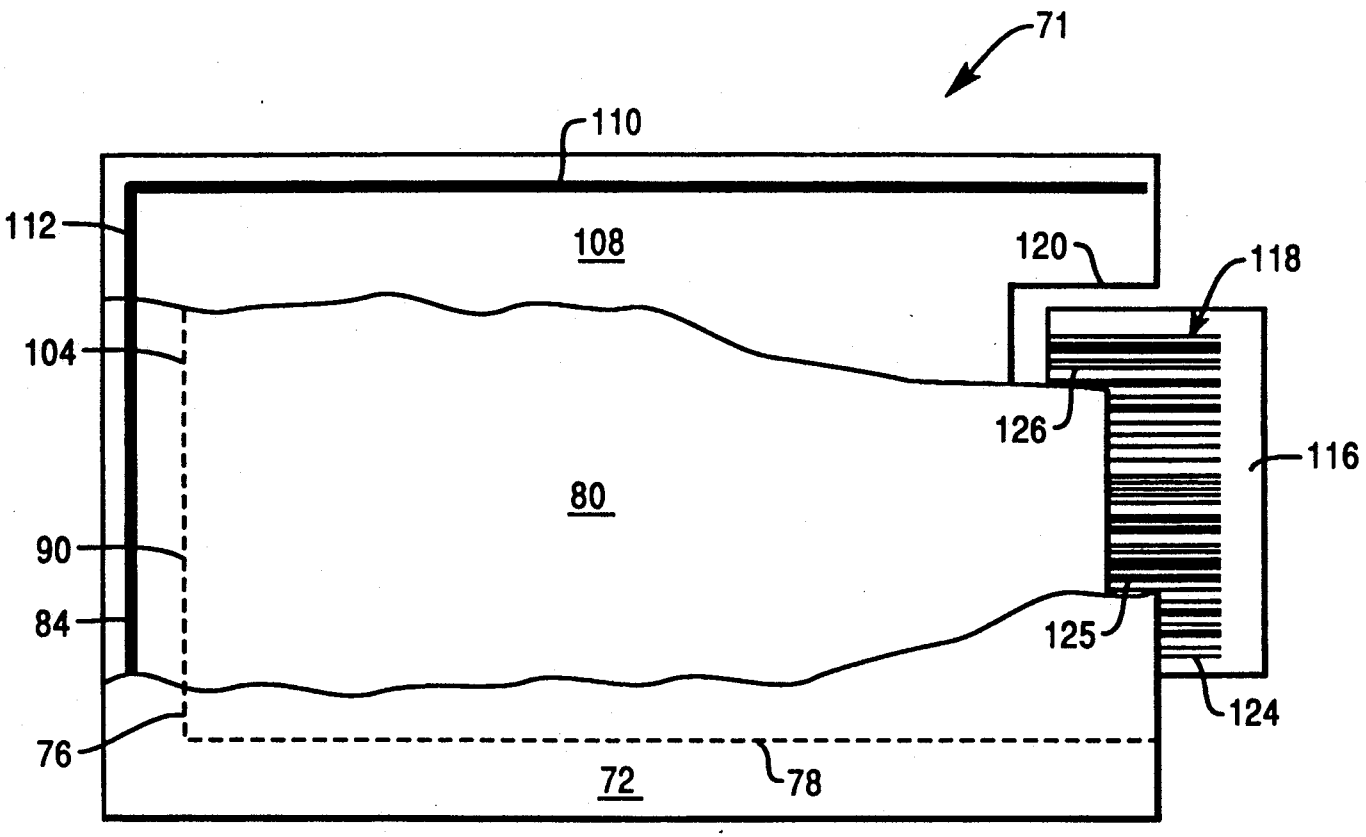
FIG. 9 is a plan view of the label of FIG. 5 showing cutaway portion of the several layers and illustrating a bar code symbol portion in position for placing on an item or article.

A third ply 108 is a label ply that has a portion that extends beyond the right hand edge of each of plies 72 and 80 (FIGS. 5, 6 and 9). The third ply 108 has a glue line 110 adjacent and spaced from the upper edge of the ply, a glue line 112 adjacent and spaced from the left hand edge of the ply, and a glue line 114 adjacent and spaced from the lower edge of the ply 108.

In an as made condition (FIGS. 5 and 7), a label portion 116 extends outwardly from the right hand edge of the ply 108 and provides space for a bar code symbol 118 to be imprinted thereon. The third ply 108 has a cutout portion 120 (FIGS. 5 and 7) for accommodating the label portion 116 when the label is attached to an item. The label portion 116 is separable from or discontinuously arranged with the label ply 108. The bar code symbol 118 has a bar code portion 124 (FIGS. 7 and 9), designated as a right hand portion, a central portion 125, and the bar code symbol has a bar code portion 126, designated as a left hand portion. When the label is attached to an item, the respective bar code portion is removed to a new location within the cutout portion of ply 108 such that the bar code portion 124 is positioned to the right of the right hand edge of ply 72, the central portion 125 is positioned under the right hand edge of ply 72 and to the right of the right hand edge of ply 80, and the bar code portion 126 is positioned under the right hand portion of ply 80 and just to the right of the left limit or edge of the cutout portion 120 of ply 108 (FIG. 9).

It is seen from this arrangement that when the label is positioned on an item ready for use the bar code portion 124 can be read when the first and second plies 72 and 80 of the label 71 are intact, that the central portion 125 can be read when the ply 72 is removed from the label 71 along perf lines 74, 76 and 78 (FIGS. 5 and 6), and that the bar code portion 126 can be read when the ply 80 is removed along perf lines 88, 90 and 92.

The label ply 108 has an adhesive coating on the back side thereof and a label liner 122 is provided over the adhesive coating and extends beyond the right edge of the ply 108. The label liner 122 is easily removed with the aid of a slit 140 (FIGS. 5 and 8) from the back side of the label ply 108 so as to enable the ply to be attached to a package or container, as 138 in FIG. 10. The label liner 122 has a cutout, as 128 in FIG. 5, so that the bar code portion 116 can be adhered directly to a package, and can be positioned wherein such bar code portion is partially covered by plies 72 and 80 (FIG. 9).

It is seen that the second embodiment, as illustrated in FIGS. 6 and 9 and described above, discloses a label that provides for retention of the required quality of a machine-readable image 118 in cases where the image must be readable throughout the various steps of a process. The image 118 must be readable under certain conditions wherein the label 71 is attached to an item or product 138 and the item is subject to spray paint or like foreign material at one or more stations along a process line. The label 71 also combines features of simultaneously retaining the legibility of human-readable information such as a work order, an address, stocking location, or instructions of a specific nature printed on the main body of the plies 72, 80 and 108 along with the retention of the machine-readable image 118.

The label form 71 comprises a carbonless multiple ply business form that incorporates a pressure-sensitive label as the back ply 108 and a plurality of overlying plies 72 and 80 as required in the manufacturing process. The number of overlying plies is limited to the number which can be effectively imaged by an impact type printer that is used to image the label form 71 for applications which incorporate the human-readable information.

The label form 71, as manufactured, is generally divided into three areas which comprise the work order area toward the left hand side of the label, the bar code symbol area at the right hand side of the label, and a specialized bar code symbol protection area that is positioned between the work order area and the bar code symbol area. The bar code protection area consists of the recess 120 in the label ply 108 and the reverse shingled section of the plies 72 and 80 overlying the label ply in the recessed area (FIGS. 5 and 8). These three areas may be oriented side-by-side across the web direction or oriented in sequence in the web direction, as required or as most convenient for the manufacturing process and the use of the label form.

Figure 7:
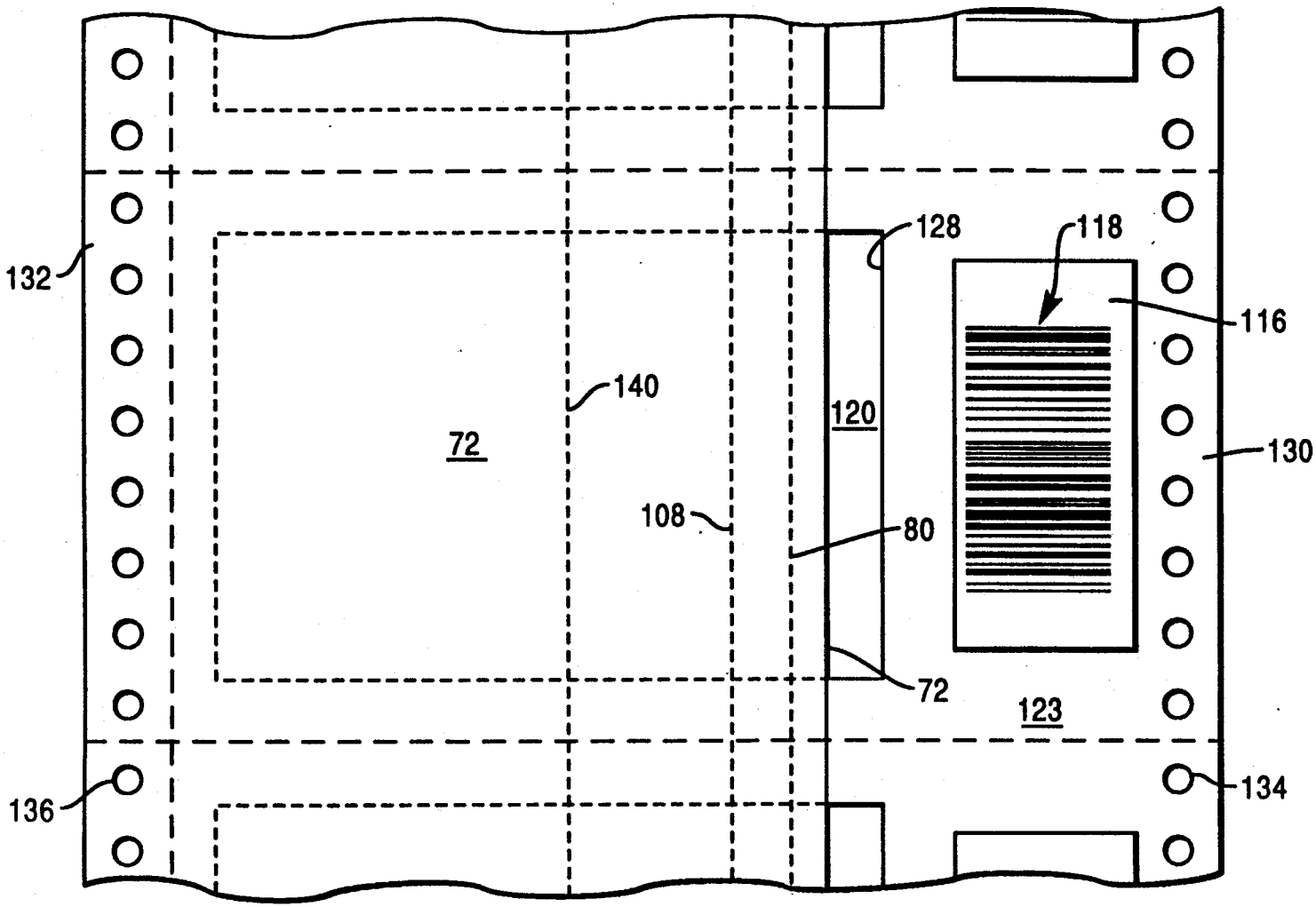
FIG. 7 is a plan view showing the arrangement of the portions of the label of FIG. 5 in an as-made form.
Figure 10:
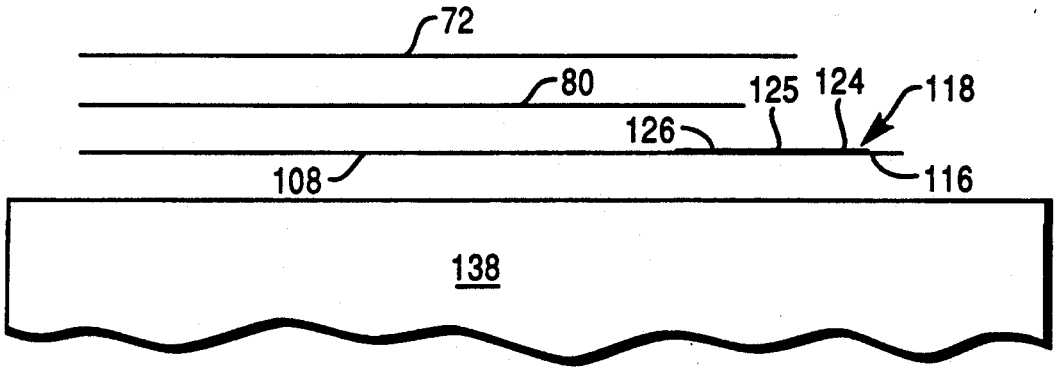
FIG. 10, on the sheet with FIG. 8, is an end view showing the arrangement of the layers of the label of FIG. 5 when attached to an item or article.

As originally made and as imaged with the imprinted work order and the imprinted bar code, as shown in FIG. 7, the bar code portion 116 of the label ply 108 is located adjacent but not under the overlying plies. Referring again to FIG. 7, the label form 71, as originally made on a press or like machine, includes a right hand margin 130 with pin feed holes 134 and a left hand margin 132 with pin feed holes 136. However, when the label 71 is affixed to an in-process manufactured item, as shown in FIG. 10, the bar code portion 116 fits into the recessed area 120 of the body of the form and partially under the reverse shingled portion of the overlying plies 72 and 80 in the specialized bar code symbol protection area (FIG. 9).

The overlying plies 72 and 80 are glued around their respective perimeters to each other and to the face stock of the label ply 108 on all sides except along the side of the recess 120 in the label ply. Each of the overlying plies 72 and 80 includes the respective perforated lines 74, 76, 78, 88, 90, 92 along the three glued sides inward of the respective glue lines 82, 84, 86, 110, 112, 114. This construction allows for convenient removal of each overlying ply when its protective function has been performed along the process line. A variation of the gluing and perforating arrangement may be done on only two opposite edges of the form 71 providing no glue is applied to the side containing the recess 120 in the label ply 108.

When the label 71 is affixed to a manufactured item 138 (FIG. 10) for moving along a process line, a full length portion 124 of the bar code 118 is displayed that is sufficient for machine reading of the bar code (FIG. 9). When the item is spray painted, the exposed portion of the bar code image, as portion 124, and the exposed work order image portion of the label may be obliterated by the paint. The removal of the top ply 72 along the perforation lines 74, 76, 78 exposes a fresh portion 125 of the bar code 118 and a clear image of the work order. If portion 125 is obliterated at a next step in the process, ply 80 can be removed along perf lines 88, 90, 92 to expose a fresh portion 126 of the bar code 118. This process of removal of a top or a lower ply may be repeated as often as allowed by the number of removable, reverse shingled, overlying plies.

It is seen that the multiple ply, pressure-sensitive, business form with a pressure-sensitive label as a last or back ply is used to identify and aid in direct processing when affixed to an in-process item. The business form is constructed in an as-made state wherein a human-readable image is entered on the multiple ply portion of the form and a machine-readable image in the nature of a bar code symbol is entered as an original image on the extended portion of the pressure-sensitive label ply of the form.

The cutout portion of the label ply and the reverse shingling of the overlying plies in the cutout area allow the machine-readable bar code symbol to be partially covered by the overlying plies when the label is affixed to the process item. In the event that the exposed images are obliterated or damaged by spray paint or the like, the removal of the top ply exposes a fresh portion of the original machine-readable symbol and a clean copy of the human-readable message.

It is thus seen that herein shown and described is a bar code label that has protection from foreign matter as the label is used in one or another application. The label assembly is used in a manner wherein one or more of the several plies may be removed and wherein the bar code symbol itself stays intact and with the package or container to which the label is secured. The present invention enables the accomplishment of the objects and advantages mentioned above, and while a preferred embodiment and a modification thereof have been disclosed herein, other variations thereof may occur to those skilled in the art. It is contemplated that all such variations and any other modifications not departing from the spirit and scope of the invention hereof are to be construed in accordance with the following claims.

What is claimed is:

1. A multiple ply label, comprising:

a first ply;

a second ply having adhesive means on the face thereof for securing said second ply to said first ply; and a third ply having adhesive means on the face thereof for securing said third ply to said second ply, said third ply having an adhesive coating on the back side thereof for attaching to an article, said third ply having an extended portion with an imprinted image thereon, said extended portion being positioned under said third ply to protect said imprinted image when said multiple ply label is attached to said article.

2. The multiple ply label in accordance with claim 1, wherein said first ply and said second ply include lines of weakening adjacent the edges of said plies to permit removal of a portion of said first ply and said second ply.

3. The multiple ply label in accordance with claim 1, further including a liner which covers the adhesive coating on the back side of the third ply, including said extended portion.

4. The multiple ply label in accordance with claim 1, wherein said adhesive means comprises lines of adhesive adjacent to and spaced from the edges of said second ply and said third ply.

5. The multiple ply label in accordance with claim 1, wherein said first ply includes a line of perforations adjacent opposite edges thereof, said second ply includes a line of adhesive and a line of perforations inward of said line of adhesive adjacent said opposite edges of said second ply, and said third ply includes a line of adhesive adjacent opposite edges thereof.

6. The multiple ply label in accordance with claim 2, further including a liner which covers the adhesive coating on the back side of the third ply, including said extended portion.

7. The multiple ply label in accordance with claim 6, wherein said adhesive means comprises lines of adhesive adjacent to and spaced from the edges of said second ply and said third ply.

8. A multiple ply label, comprising:

a first ply;

a second ply having adhesive means on the face thereof for securing said second ply to said first ply; and a third ply having adhesive means on the face thereof for securing said third ply to said second ply, said third ply having an adhesive coating on the back side thereof for attaching to an article, said third ply having an extended and separable portion with an imprinted image thereon, said imprinted image having a first image portion and a second image portion, said first image portion extending outwardly beyond said first ply for exhibiting said first image portion of said imprinted image with said first ply intact and said second image portion is covered by said first ply to protect said second image portion of said imprinted image when said multiple ply label is attached to said article.

9. The multiple ply label in accordance with claim 8, wherein said first ply and said second ply include lines of weakening adjacent the edges of said plies to permit removal of a portion of said first ply and said second ply.

10. The multiple ply label in accordance with claim 8, further including a liner which covers the adhesive coating on the back side of the third ply, including said extended and separable portion.

11. The multiple ply label in accordance with claim 8, wherein said adhesive means comprises lines of adhesive adjacent to and spaced from the edges of said second ply and said third ply.

12. The multiple ply label in accordance with claim 8, wherein said first ply includes a line of perforations adjacent opposite edges thereof, said second ply includes a line of adhesive and a line of perforations inward of said line of adhesive adjacent said opposite edges of said second ply, and said third ply includes a line of adhesive adjacent opposite edges thereof.

13. The multiple ply label in accordance with claim 8, wherein said imprinted image includes a third image portion positioned under and covered by said second ply for exhibiting said second image portion of said imprinted image when said first ply is removed and for protecting said third image portion of said imprinted image when said multiple ply label is attached to said article.

14. The multiple ply label in accordance with claim 8, wherein said third ply includes a cutout portion for accommodating said extended and separable portion.

15. The multiple ply label in accordance with claim 9, further including a liner which covers the adhesive coating on the back side of the third ply, including said extended and separable portion.

16. The multiple ply label in accordance with claim 15, wherein said adhesive means comprises lines of adhesive adjacent to and spaced from the edges of said second ply and said third ply.

17. The multiple ply label in accordance with claim 16, wherein said imprinted image includes a third image portion positioned under and covered by said second ply for exhibiting said second image portion of said imprinted image when said first ply is removed and for protecting said third image portion of said imprinted image when said multiple ply label is attached to said article.

18. The multiple ply label in accordance with claim 17, wherein said third ply includes a cutout portion for accommodating said extended and separable portion.

* * * * *